United States Patent [19]

Crisp

[11] 4,230,132

[45] Oct. 28, 1980

[54] CIGARETTE MAKING MACHINE

[75] Inventor: David Crisp, London, England

[73] Assignee: Rizla Limited, Glamorganshire, Wales

[21] Appl. No.: 963,993

[22] Filed: Nov. 27, 1978

[30] Foreign Application Priority Data

Nov. 28, 1977 [GB] United Kingdom ..... 49401/77

[51] Int. Cl.[3] ..... A24C 5/02; A24C 5/39; A24C 5/42

[52] U.S. Cl. ..... 131/70; 131/75

[58] Field of Search ..... 131/70–75

[56] References Cited

U.S. PATENT DOCUMENTS

| | | | |
|---|---|---|---|
| 2,314,734 | 3/1943 | Ptasnik | 131/70 |

FOREIGN PATENT DOCUMENTS

| | | | |
|---|---|---|---|
| 770951 | 11/1967 | Canada | 131/70 |
| 973048 | 8/1975 | Canada | 131/70 |
| 1039603 | 10/1978 | Canada | 131/70 |
| 340841 | 1/1931 | United Kingdom | 131/70 |
| 464948 | 4/1937 | United Kingdom | 131/70 |
| 507125 | 6/1939 | United Kingdom | 131/70 |
| 717167 | 10/1954 | United Kingdom | 131/70 |
| 725058 | 3/1955 | United Kingdom | 131/70 |
| 726742 | 3/1955 | United Kingdom | 131/70 |
| 902887 | 8/1962 | United Kingdom | 131/70 |
| 1176433 | 1/1970 | United Kingdom | 131/70 |
| 1321015 | 6/1973 | United Kingdom | 131/70 |

*Primary Examiner*—V. Millin

*Attorney, Agent, or Firm*—Wender, Murase & White

[57] ABSTRACT

The invention relates to a cigarette making machine of the kind having a fixed member and a movable packing block together defining a cylindrical cavity for compressed tobacco, a nozzle communicating with the end of the cavity for supporting a preformed paper tube and an ejector for ejecting the charge of compressed tobacco through the nozzle into the paper tube. A new operating mechanism for such a machine comprises a sliding member including a rack and a pivoted lever secured to the compression member having gear teeth in meshing engagement with the rack and operatively connected to the ejector. Restraining means restrains rotation of the lever during a first portion of the travel of the sliding member during which the tobacco is being compressed, after which said means disengages from the lever to permit rotation thereof in a second portion of the travel of the sliding member in which said ejector forces the charge of compressed tobacco through the nozzle into the paper tube. The mechanism is simple and compact and it enables both the compression and the ejection operations to be carried out smoothly using a single operating handle.

10 Claims, 6 Drawing Figures

CIGARETTE MAKING MACHINE

FIELD OF THE INVENTION

This invention relates to cigarette making machines and is particularly concerned with a portable machine for filling a preformed paper tube with a compressed plug of tobacco to form a cigarette.

SUMMARY OF THE PRIOR ART

In its simplest form, a manually operated machine for filling preformed paper tubes comprises a two-part casing defining a cylindrical cavity and an ejector piston within the said cavity. Examples of such machines are to be found in U.K. Patent Specifications Nos. 340841 (Cantounis), 717167 (Bloom) and 902887 (Ritter et al). In a modified form of machine described in U.K. Specification No. 507125 (Boerner) tobacco is forced into a cylindrical trough by means of a compression member or rammer and then injected into the cigarette tube by means of a combined tobacco spoon and rammer. Both of these types of machine are operated directly by the user without any mechanism intervening between him and the tobacco.

In addition to these simple machines there has been a requirement for a slightly more elaborate machine in which the operations of compression of a charge of tobacco to form a cylindrical plug and injection of the tobacco plug into the paper tube are carried out through an intermediate mechanism which reduces the operating force required and provides a more consistent product. A known type of mechanism for these machines which employs connecting rods forming a pair of jointed parallelograms to actuate a compression device and employs a combined ejector piston tobacco spoon is described in U.K. Specifications Nos. 464948 (Chaze) and 726742 (Kastner) and Canadian Specification No. 973048 (Kastner). Other known machines are described in U.K. Specifications Nos. 725058 (Kastner), 1176433 (Efka-Werke) and 1321015 (Kastner).

As will be apparent from the references mentioned above, attempts have been made to operate both the tobacco compression and the tobacco ejection mechanisms by means of a single operating lever in order to make the machines more convenient and simple to use. However, the known machines require complicated linkages involving a large number of 15 working parts and are thus expensive owing to their complexity.

SUMMARY OF THE INVENTION

The present invention aims to provide a cigarette making machine which is simple and compact and enables the machine to be operated by a single lever.

According to the invention, there is provided a cigarette making machine comprising:

a fixed member having a first semi-cylindrical surface;

a compression member having a second semi-cylindrical surface and movable between a first position in which said first and second surfaces are radially spaced and a second position in which said surfaces abut to define a cylindrical cavity for a charge of compressed tobacco;

means defining a slot through which tobacco can be inserted, with the compression member in the first position, into a space between said first and second surfaces;

a nozzle communicating with an end of said cavity and adapted to receive the end of a preformed paper tube; means for ejecting a charge of compressed tobacco through said nozzle into said paper tube;

a sliding member actuated for movement towards or away from the first semi-cylindrical surface and including a first rack;

a lever pivotally secured to said compression member, operatively secured to said ejection means and having gear teeth in meshing engagement with said rack; and restraining means adapted to restrain rotation of said lever in a first portion of the travel of said sliding member from its rest position in which said compression member travels from said first to said second positions, and to disengage from said lever when said compression member has moved to said second position whereby said lever rotates in a second portion of the travel of said sliding member to cause said ejection member to force said compressed tobacco through said nozzle into said paper tube.

The foregoing and other objects of the present invention will be apparent from the following more detailed description of a preferred embodiment thereof.

BRIEF DESCRIPTION OF THE DRAWINGS

The invention will now be further described, by way of example, with reference to the accompanying drawings, in which.

DESCRIPTION OF THE PREFERRED EMBODIMENT

Figures 1, 1A:
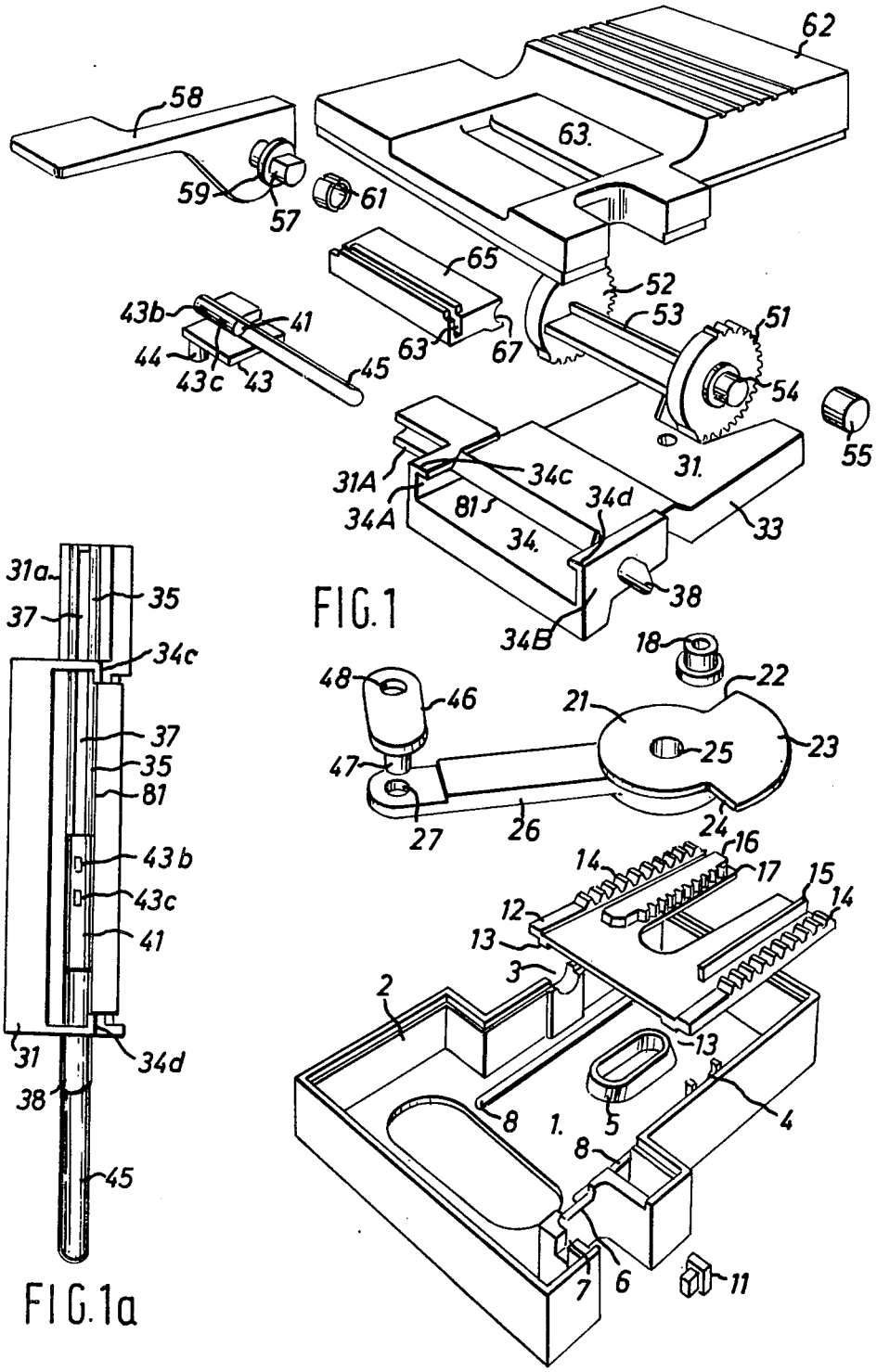
FIG. 1 is an exploded perspective view of one embodiment of a machine according to the invention.
FIG. 1*a* is an enlarged detail view of the tobacco receiving chamber in the top face of the packing block shown in FIG. 1.

Referring to the drawings, it will be seen that the machine is generally T-shaped in plan with a tobacco receiving chamber 34 in the head portion of a T-shaped casing and an actuating mechanism in the tail portion of the casing to which an operating handle 58 is also pivoted.

The machine includes a casing comprising a base 1 and a lid 62. A pin 9 projects upwardly from the base 1 (FIG. 3) adjacent the end of the tail portion thereof and on the longitudinal central line. It carries a sleeve or bush 18 of nylon or other plastics material which is free to rotate on the pin 9. The base has a peripheral wall 2, in one side of the tail portion of which a semi-circular recess 3 is formed at an intermediate lengthwise position. A bearing cup 4 is disposed against the inner face of the peripheral wall 2 on the opposite side of the tail portion at the same longitudinal position as the recess 3. Located on the base of the casing between the recess 3 and the bearing cup 4 is a guide channel 5 defined by a ring having linear side edges directed longitudinally and having semi-circular ends. A pair of longitudinally directed guide ribs 8 is also disposed symmetrically in the tail portion of the base 1 each intermediate the guide channel 5 and a respective part of the peripheral wall 2.

A recess is provided in a first side face of the head portion of the base. The region of the peripheral wall 2 at the base of the recess is formed with a spigot slot 6 directed longitudinally and the region of the peripheral wall 2 defining a forward lateral wall of the recess is formed with a further slot 7 for the reception of a buffer 11 of rubber or like resilient material. The lid 62 is shaped in conformity with the base 1 and has a peripheral wall dimensioned so as to butt against the peripheral wall 2 of the base and having a semi-circular recess corresponding to the recess 3 and a slot corresponding to the spigot slot 6. The top cover has in its head region an opening 63 which overlies the tobacco receiving chamber 34 and by means of which the chamber can be charged with tobacco. A rib 64 (FIG. 3) depending from the inner face of the cover is disposed parallel to the opening 63 on the head side of the opening. The cover 62 is further provided with a projection 68 depending from its inner face and positioned so as to be engageable with the pin 9 projecting from the base of the casing. The top cover and the base can be secured together by any suitable means, e.g., they may be screwed or snap-fitted together.

A U-shaped plate 12 is fitted in the casing to rest on the base 1 with the limbs of the U facing towards the tail of the machine and located to either side of the guide channel 5. The lower face of the plate is provided with ribs 13 which slidingly engage the ribs 8 on the base of the casing. The upper face of the plate 12 is provided along each side edge with a toothed rack 14 and spaced laterally from the racks 14 with a pair of guide ribs 15 and 16. The rib 16 is wider than the rib 15 and is provided on its inner side edge with a toothed rack 17.

Figure 5:
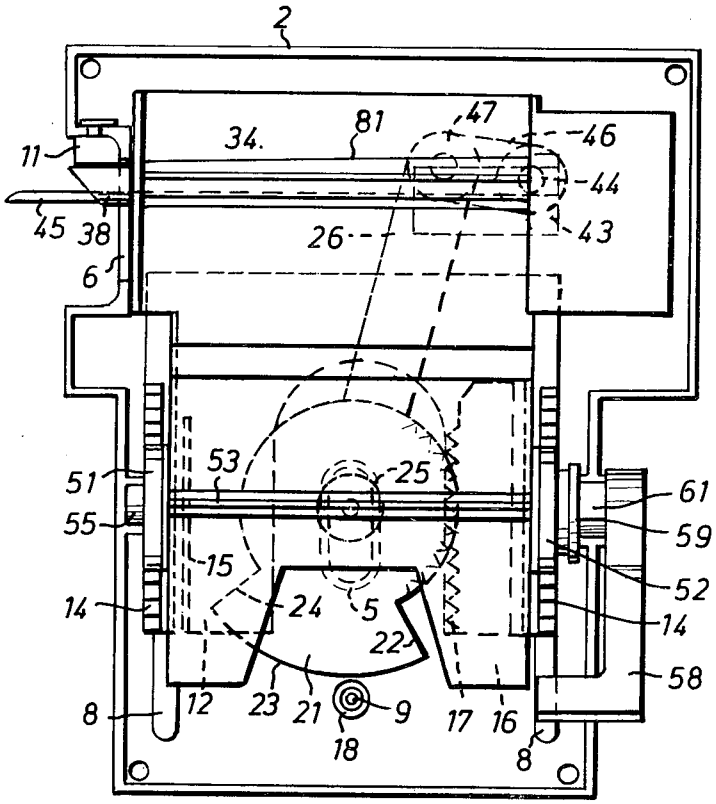
FIGS. 4 and 5 are views, corresponding to FIG. 2, showing intermediate positions of the mechanism during operation of the operating lever.
Figure 4:
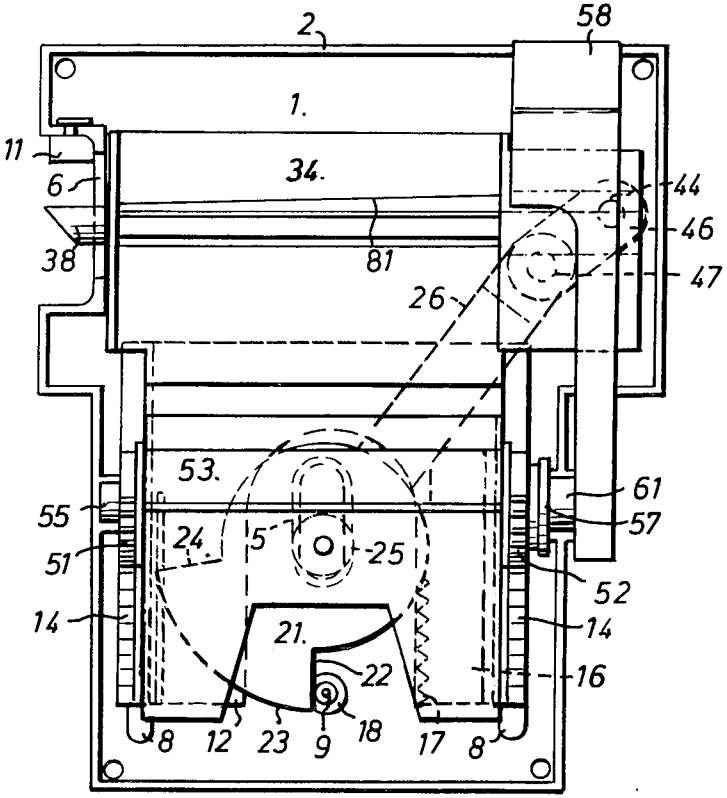

The teeth of a toothed quadrant are meshed with the teeth of the rack 17. The quadrant is formed with a radially extended sector defining a cam surface 23 bounded by end faces 22, 24. The quadrant is further provided with a central bore 25 and an arm 26 extending radially from it substantially opposite the radially extended sector. A bore 27 is provided adjacent the outer end of the arm 26. The central bore 25 receives the larger diameter portion of a compression member or stepped circular projection 32 on the lower face of a packing block 31 (described below), and the smaller diameter lower end portion of the projection 32 engages within the guide channel 5. When the projection 32 is at the tail end of the channel 5 the end face 22 engages the bush 18 on the pin 9 and prevents rotation of the quadrant. Movement of the U-shaped plate 12 forwardly towards the head of the machine moves the surface 22 past the sleeve or bush 18 until the surface 22 has disengaged therefrom and the projection 32 has reached the head end of the channel 5, after which further forward movement of the plate 12 causes the quadrant to rotate on the projection 32 in an anti-clockwise direction as seen in FIGS. 4 and 5, the curved outer face of the cam surface 23 moving past the bush 18. The above movement is reversible, rearward movement of the plate 12 first rotating the quadrant clockwise as seen in FIGS. 4 and 5. During the initial portion of the reverse movement, the cam surface 23 engages the bush 18 to permit reverse rotation of the quadrant, but to prevent tailward movement of the quadrant until the quadrant has rotated back to its original position in which the end face 22 is engageable with the bush 18 after which the quadrant is free to move tailwards and the projection 32 moves towards the tail end of the guide channel 5 while the end face 22 slides past the pin 9 supported on the sleeve or bush 18.

A packing block 31 which may be made of plastics or other suitable material is fitted over the quadrant 21 and is dimensioned to fit within the T-shaped casing. The tail portion of the packing block bears the stepped projection 32 on its lower face at an intermediate longitudinal position, and it also has a pair of depending side walls 33 which are engaged and guided by the guide ribs 15 and 16 on the plate 12. The head end of the packing block is provided in its upper face with a recess defining part of a tobacco receiving chamber 34 having a semi-cylindrical end wall 35 and front and rear side walls 34B and 34A respectively. A nozzle 38 is provided on the front side wall 34B of the block, and it surrounds and extends from a bore in the side wall at the front end of the tobacco receiving chamber. A generally horizontal slot 37 is formed in the semi-cylindrical end wall 35 and is continued in a rearward extension 31A of the packing block, the head end face of the extension 31A conforming to the curvature of the wall 35 and a bore being formed in the rear side wall 34A in alignment with the end wall 35. A plunger 41 has a pair of axially spaced apertures alignable with a corresponding aperture at the rear end of a tobacco spoon 45. A slide comprises a plate 43 bearing on its lower face a peg 44 and on its upper face a vertical web 43A terminating in horizontally directed fixing lugs 43B and 43C. The slide is fitted to the packing blocks with the fixing lugs 43B and 43C projecting through the slot 37, and the slot in the tobacco spoon 45 is engaged with the fixing lugs, after which the plunger 41 is snap fitted to retain the tobacco spoon in place. Accordingly the resulting tobacco spoon assembly is slideable in either direction transversely of the machine between an extended position in which the front end of the tobacco spoon projects through nozzle or the spigot 38 and a retracted position in which the front end of the tobacco spoon overlies the semi-cylindrical end wall 35 and the plunger 41 has moved backward into the rearward extension 31A. The tobacco spoon 45 may be provided, in known manner, throughout its length with projections which serve to advance the tobacco into a preformed paper cigarette tube but which permit the spoon to be withdrawn from the tube after filling without disturbing the tobacco therein. The upper ends of the side walls 34A and 34B bear inwardly directed flanges 34C and 34D which retain a fixed member 65 of plastics or the like material which has a semi-cylindrical tail end face 67 and a transverse slot 66 in its top face which engages the rib 64 on the inner face of the cover to prevent relative longitudinal movement between the compression member and the cover. The upper surface of the packing block is extended to form a top wall 80 to the compression chamber in spaced parallel relationship to the floor thereof and terminating in a cutting edge 81 directed obliquely at a small acute angle to the top edge of the compression member 65. When the packing block 31 is at the tail end limit of its travel the fixed member 65 is moved clear of the cutting edge 80 to define an opening into the tobacco receiving chamber 34, which opening registers with the tobacco slot 63 in the cover. As the packing block moves towards the head of the machine, the cutting edge 81 passes over the top inner end of the fixed member 65 and because of its slightly oblique direction cooperates with the adjoining edge of the compression member to exert a guillotine-like cutting action on strands of tobacco protruding from the tobacco receiving chamber 34. At the head end of the travel of the packing block, the semi-cylindrical surfaces 35 and 67 define a generally cylindrical cavity containing a plug of compressed tobacco.

The slide is connected to the quadrant 21 by a connecting link 46 having a peg 47 for engaging in the bore 27 at the outer end of the arm 26 of the quadrant and a bore 48 for receiving the peg 44 projecting from the lower face of the plate 43. The pegs 44 and 47 are free to rotate in their respective bores 48 and 27.

A driven pinion assembly comprising a pair of pinions 51 and 52 interconnected by a bar 53 of T-shaped cross-section lies on top of the packing block 31 with the teeth of the pinions 51 and 52 in meshing engagement with the racks 14 on the plate 12. The pinion 51 is provided with a cylindrical stub shaft 54 on the side remote from the bar 53. A bearing cup 55 of nylon or like material is fitted over the shaft 54 and, in the assembled condition of the mechanism, is received in the cup 4 in the casing. The other pinion 52 is provided, in its side remote from the bar 53, with a substantially D-shaped recess (not shown) adapted to receive a projection 57 of corresponding section provided on a handle 58. The projection 57 forms the end of a shaft extending at right-angles from one end of the handle and provided intermediate its ends with a flange 59. Between the flange 59 and the handle 58 the shaft is of circular cross-section and a split bearing 61 of nylon or like material is fitted thereover. When the projection 57 is located in the recess in the pinion 52 and said pinion is meshed with the corresponding rack 14, the bearing 61 is received in the recess 3 in the wall 2 of the casing.

Figure 3:
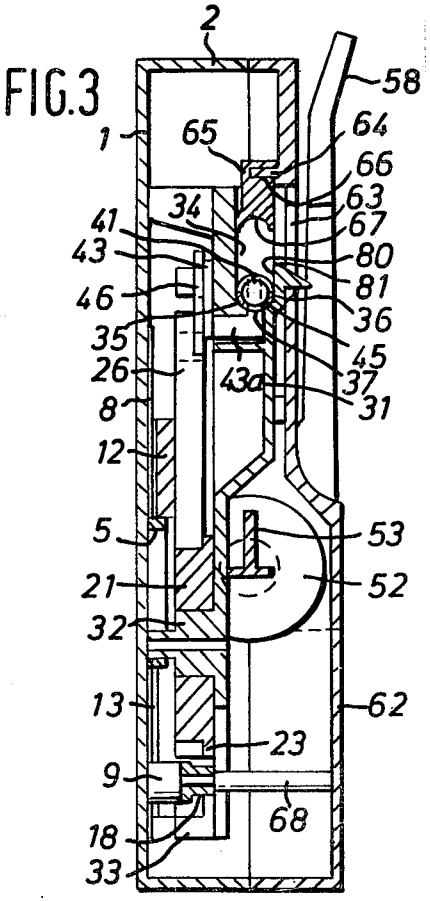
FIG. 3 is a section taken on the line III—III in FIG. 2 and showing the top cover in position.
Figure 2:
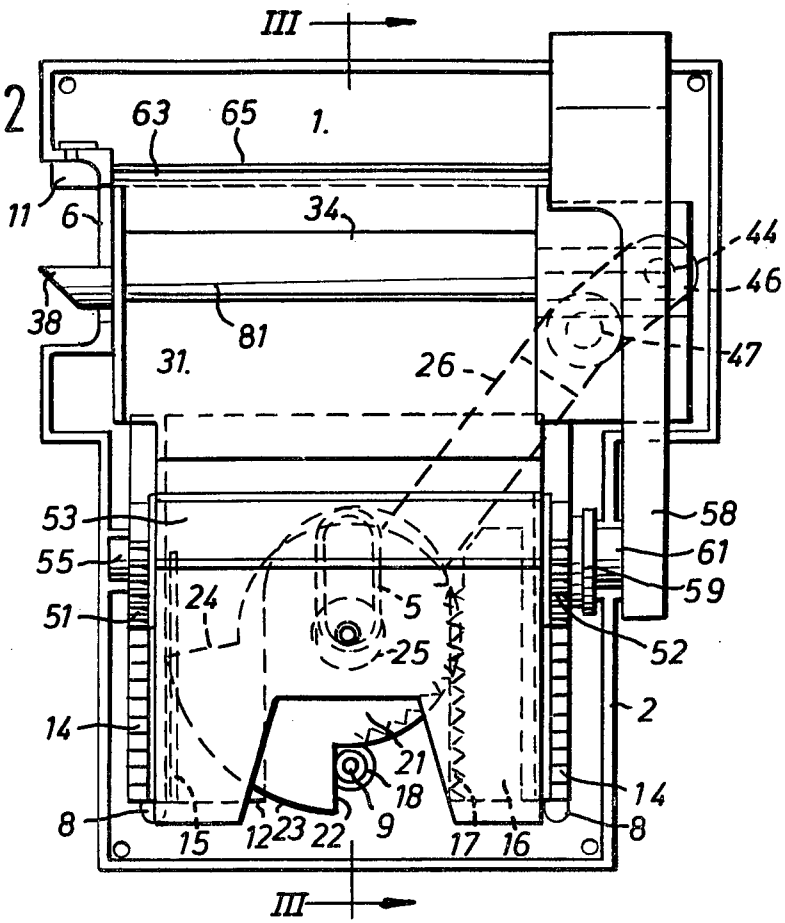
FIG. 2 is a plan view of the machine shown in FIG. 1 with the top cover removed and showing the operating lever in the inoperative position.

In order to make a cigarette with the machine according to the invention, the operating handle 58 is located in the position shown in FIGS. 2 and 3 in which the handle extends substantially parallel to the base and cover of the casing. In this position of the handle 58, the stepped projection 32 is located at the tail end of the oval guide channel 5, the end face 22 of the quadrant 21 bears against the bush 18 and the nozzle 38 is at the rear end of the recess 6. The end of a preformed paper tube is fitted onto the nozzle 38 and an appropriate charge of tobacco for a single cigarette is inserted through the tobacco slot 63 into the chamber 34. The handle 58 is then pivoted away from the top of the casing, i.e., in the clockwise direction as viewed in FIG. 3. Pivoting of the handle causes the pinions 51 and 52 to rotate which, by virtue of their engagement with the racks 14, causes the plate 12 to slide along the ribs 8 on the base of the casing towards the head of the machine. The teeth 17 on the guide rib 16 are meshed with the teeth of the quadrant 21 but rotation of the quadrant is prevented because the end face 22 remains in engagement with the bush 18 as shown in FIG. 4. The quadrant is therefore forced to move bodily with the plate 12. Since the quadrant is mounted on the packing block 31 by means of the stepped projection 32, the packing block is also moved so that the wall 35 is advanced towards the wall 67 to reduce the volume of the chamber 34, which becomes closed off by movement of the wall 80 over the compression member 65. Further pivoting of the handle 58 continues to move the quadrant and the packing block longitudinally towards the head of the machine until the end of the projection 32 abuts the head end of the oval guide channel 5. In this position, the packing block 31 has been moved to a position in which the ends of wall 35 meet the ends of the wall 67 to define a cylindrical chamber holding a compressed plug of tobacco and the nozzle 38 abuts the buffer 11 whereby the end of the paper tube is gripped between the nozzle and the buffer. At the same time, the quadrant 21 has been moved to a position in which the end face 22 disengaged from the bush 18. With further pivoting of the handle 58, the quadrant 21 is now caused to rotate in an anticlockwise direction as viewed in FIG. 5 since the plate 12 is still being driven towards the head of the machine by the pinions 51 and 52 engaging the racks 14. Rotation of the quadrant 21 causes the arm 26, via the link 46, to move the plunger 41 to the left as viewed in FIG. 5 so that the plug of compressed tobacco and the spoon 45 are fed into the paper tube on the nozzle 38.

The pivoting movement of the handle is stopped when the end face 22 abuts the rib 16 and anti-clockwise movement of the arm 26 has moved the plunger 41 to the end of its travel. In this position, the spoon 45 has fully entered the paper tube and the front, tobaco advancing, end of the plunger 41 is located within the nozzle 38. The handle is then pivoted in an anti-clockwise direction as viewed in FIG. 3. Initial pivoting of the handle causes the quadrant to rotate in a clockwise direction, the cam surface 23 slidably or rotatably engaging the bush 18 and preventing tailward movement of the packing block until the end face 22 registers with the bush 18 during which the plunger 41 is retracted and the tobacco spoon 45 is withdrawn from the paper tube.

When the plunger 41 has been moved to its fully withdrawn position in which it is no longer located in the chamber 34 and the spoon has been completely withdrawn from the paper tube, the quadrant has been rotated to a position in which the bush 18 is no longer engaged by the cam surface 23 but is engaged instead by the end face 22 and in which further rotation of the quadrant is prevented by the abutment of the arm 26 with the rack 16. On further pivoting of the handle 58, the quadrant 21 now moves bodily with the plate 12 to return the packing block to the position shown in FIG. 2. Since the nozzle 38 is now no longer in engagement with the buffer 11, the formed cigarette can be pulled off the nozzle.

It will be seen that, with the machine according to the invention, cigarettes can be made by operating a single lever which actuates a relatively simple mechanism involving few moving parts. The casing and cover may be die-cast metal components or may be made of plastics mouldings or other suitable materials. The plate 12, quadrant 21, pinions 51, 52 and bar 53, and the handle 58 may be made of metal, plastics or other suitable materials.

Other embodiments and modifications are envisaged without departing from the scope of the invention.

I claim:

1. A cigarette making machine comprising:

a fixed member having a first semi-cylindrical surface;

a compression member having a second semi-cylindrical surface and arranged for translational movement between a first position in which said first and second surfaces are radially spaced and a second position in which said members abut, said first and second surfaces together forming a space in which a charge of tobacco is compressed into a cylindrical plug;

means defining a slot through which said charge of tobacco can be inserted, with the compression member in the first position, into a space between said first and second surfaces;

a nozzle communicating with an end of said cavity and adapted to receive the end of a preformed paper tube;

means for ejecting said cylindrical plug of compressed tobacco through said nozzle into said paper tube;

a lever pivotally secured to said compression member for translational movement together with said compression member between said first and second positions and for rotational movement relative to said compression member about a pivot point, said lever being operatively coupled to said ejection means for producing ejection of said plug of compressed tobacco in response to rotation of said lever;

restraining means cooperating with said lever to prevent rotational movement of said lever except when said compression member and said lever are in said second position; and actuating means engaging said lever at a point spaced from said pivot point for applying a driving force thereto in a direction from said first position to said second position, prevention of rotation of said lever by said restraining means causing transmission of said driving force through said lever to said compression member so that initially said lever and said compression member together undergo translational movement from said first position to said second position, further application of said driving force to said lever at said second position thereafter causing rotation of said lever, whereby said actuating means causes a charge of tobacco to be compressed and then ejected through said nozzle into said paper tubes to form a finished cigarette.

2. A machine according to claim 1, wherein said actuating means comprises a sliding member actuated for translational movement towards and away from said first semi-cylindrical surface and including a first rack; and wherein said lever is provided with gear teeth in meshing engagement with said rack.

3. A machine according to claim 2, wherein said sliding member is actuated by means of a pivoted operating handle.

4. A machine according to claim 3, wherein said lever is pivotally mounted on a stud depending from a normally lower face of said compression member and through which actuating forces are transmitted from said first rack to said compression member, the lower end of said stud slidably engaging a guide channel having a first end which engages the stud when the compression member reaches the second position to prevent said lever from moving further towards said first-surface.

5. A machine according to claim 4, wherein said guide channel has a second semi-cylindrical end which engages said stud when said compression member is returned to said first position.

6. A machine according to claim 5, wherein the outer end of said lever is connected to said ejector by means of a link pivoted at its ends to said ejector and to said lever.

7. A machine according to claim 6, wherein said lever has a hub region having a quadrant whose teeth engage said first rack, said hub region having a radially extended sector bounded by first and second end faces, said first end face engaging a bush supported on a pin when said compression member is in the first position to prevent rotation of said lever but to allow relative linear movement between said lever and said pin but to prevent rotation of the lever, and disengaging from said bush when said compression member has reached said second position whereby said lever is free to rotate.

8. A machine according to claim 7, wherein said sliding member is a generally U-shaped plate slidable on guide means towards and away from said first semi-cylindrical surface, said plate having second and third racks in meshing engagement with a pair of interconnected pinions keyed to an operating handle.

9. A machine according to claim 8, wherein the upper surface of said compression member is extended to form a top wall to the tobacco receiving chamber terminating in a cutting edge directed obliquely to the top edge of said fixed member, said top wall moving over said fixed member as the compression member travels to the second position whereby said cutting edge cooperates with said fixed member to exert a guillotine-like cutting action on protruding strands of tobacco.

10. A machine according to claim 9, wherein a friction block is positioned adjacent said nozzle so that as said compression member travels to said second position said nozzle presses against said friction block to retain said paper tube in position on said nozzle.

* * * * *